US005830540A

United States Patent [19]

Bowers

[11] Patent Number: 5,830,540

[45] Date of Patent: Nov. 3, 1998

[54] METHOD AND APPARATUS FOR REACTIVE PLASMA SURFACING

[75] Inventor: Jim Bowers, Lakewood, Colo.

[73] Assignee: Eltron Research, Inc., Boulder, Colo.

[21] Appl. No.: 687,265

[22] Filed: Jul. 25, 1996

Related U.S. Application Data

[63] Continuation of Ser. No. 306,809, Sep. 15, 1994, abandoned.

[51] Int. Cl.[6] ..... H05H 1/24; B05D 1/02; C23C 4/10; H01T 14/00

[52] U.S. Cl. ..... 427/562; 427/563; 427/564; 427/571; 427/574; 427/578; 427/576; 427/577; 427/580; 427/447; 427/450; 427/452

[58] Field of Search ..... 427/447, 450, 427/451, 452, 453, 455, 456, 490, 536, 540, 571, 569, 576, 578, 577, 579, 574, 580, 562, 563, 564, 539, 534, 535, 523, 529, 530

[56] References Cited

U.S. PATENT DOCUMENTS

| | | | |
|---|---|---|---|
| 3,443,980 | 5/1969 | McBride | 427/540 |
| 3,677,799 | 7/1972 | Hou | 427/580 |
| 3,679,418 | 7/1972 | Stroszynski | 427/450 |
| 4,292,342 | 9/1981 | Sarma et al. . | |
| 4,333,962 | 6/1982 | Pulker et al. | 427/580 |
| 4,505,947 | 3/1985 | Vukanovic et al. . | |
| 4,505,948 | 3/1985 | Pinkhasov | 427/580 |
| 4,529,664 | 7/1985 | Hart | 427/540 |
| 4,587,430 | 5/1986 | Adler . | |
| 4,704,168 | 11/1987 | Salik et al. . | |
| 4,762,756 | 8/1988 | Bergman et al. | 427/580 |
| 4,818,351 | 4/1989 | Arai et al. . | |
| 4,881,983 | 11/1989 | Smith et al. . | |
| 4,931,306 | 6/1990 | Pinkhasov . | |
| 4,981,756 | 1/1991 | Rhandhawa . | |
| 4,999,215 | 3/1991 | Akagi et al. . | |
| 5,041,304 | 8/1991 | Kusano et al. | 427/535 |
| 5,062,900 | 11/1991 | Berneron et al. . | |
| 5,094,878 | 3/1992 | Yamamoto et al. | 427/580 |
| 5,104,509 | 4/1992 | Buck et al. | 427/580 |
| 5,114,510 | 5/1992 | Wright | 427/535 |
| 5,126,030 | 6/1992 | Tamagaki et al. | 427/580 |
| 5,138,520 | 8/1992 | McMillan et al. . | |

(List continued on next page.)

OTHER PUBLICATIONS

Matsuda, Nakata, Makishi, and Kiya, "Surface Hardening of Ni Alloys by Means of Plasma Ion Nitriding (PIN) Process (Report II)," Transaction of JWRI, v17, No. 2 (1988) No Month.

Matsuda, Nakata, Makishi and Kiya, "Corrosion Behavior of Tentative Nickel Binary and Ternary Alloys after Plasma Ion Nitriding Treatment," Transactions of JWRI, v17, No. 2(1988) No Month.

Li, O'Keefe and James, "Iron Carbide Films Formed by Plasma Deposition in Plasma Carburizing," Materials Science & Engineering, B. Solid–Stat, v7 N. 1/2, 15. (Sep. 1, 1990).

Kanayama, Horie and Nakayama, "Plasma–Carburizing of Tungsten with a $C_3H_8$–$H_2$ Mixed Gas," Isij International, v.33, N. 5, 615, (1993) No Month.

Ricard, Oseguera–Pena, Falk, Michel, and Gantois, "Active Species in Microwave Postdischarge for Steel–Surface Nitriding," I.E.E.E. Transactions on Plasma Science, v.18, No. 6 (Dec., 1990).

*Primary Examiner*—Marianne Padgett
*Attorney, Agent, or Firm*—Greenlee, Winner and Sullivan, P.C.

[57] ABSTRACT

A method and apparatus for reactive plasma surfacing includes at least two electrodes between which reactive gases are passed. The reactive gases are ionized by the arc between the electrodes, creating a plasma of heated, ionized, reactive gases. The plasma is then applied to a surface to be treated, causing a chemical reaction between the plasma and the surface and resulting in a new diffusional substrate surface on the treated object. The process occurs at substantially atmospheric pressure, and may include an inert gas to shield the process from the surrounding environment.

4 Claims, 3 Drawing Sheets

U.S. PATENT DOCUMENTS 5,143,748 9/1992 Ishikawa et al. ..... 427/569
5,176,760 1/1993 Young .
5,213,848 5/1993 Zurecki et al. ..... 427/580
5,217,748 6/1993 Kestelman et al. ..... 427/580
5,226,975 7/1993 Denton et al. .
5,240,514 8/1993 Yasuura et al. .
5,260,106 11/1993 Kawarada et al. ..... 427/580
5,296,272 3/1994 Matossian et al. .
5,299,731 4/1994 Liyanage et al. ..... 427/580
5,302,422 4/1994 Nowak et al. .
5,308,707 5/1994 Cellier et al. .
5,466,424 11/1995 Kusano et al. ..... 427/539

METHOD AND APPARATUS FOR REACTIVE PLASMA SURFACING

This is a continuation of application Ser. No. 08/306,809, filed on Sep. 15, 1994, now abandoned.

TECHNICAL FIELD

This invention was made with Government support under Contract Number N00024-93-C-4207 awarded by the Department of the Navy. The Government has certain rights in this invention.

This invention relates to methods and apparatuses for treatment of metal or ceramic surfaces, and more particularly to a method and apparatus for treating such surfaces with a plasma of heated ionized reactive gases to form a new diffusional substrate surface.

BACKGROUND ART

Metal corrosion and ceramic erosion are ongoing problems respectively in aqueous and molten salt environments. The problem of corrosion has been addressed by (1) deposition of layers which prevent electrolyte contact with the metal surface, such as anodization, or (2) cathodic protection schemes. Coatings which attempt the first approach invariably develop holes which allow very rapid attack in the form of pitting or crevice corrosion. The second approach has required expensive state-of-the-art control in metal alloy composition and final heat treatment at the mill to obtain optimum grain structure at the substrate/electrolyte interface. In order to reduce expense and prolong wear in structures made of less corrosion-resistant materials specialized alloys may be deposited or weld-overlayed on surfaces exposed to corrosion or erosion. Flame spray metal deposition, cementation packing, and high velocity oxyfuel/metal deposition have routinely been applied to the problem with inadequate results due to holes or debonding developing in the non-diffusional layer leading to pitting and crevice corrosion. Sacrificial metal has been used to prevent corrosion on critical surfaces, but these are acceptable only until the sacrificial metal is consumed. Welds are areas of corrosion where no acceptable metallurgical solution exists due to the heat effects at the zone not melted and just adjacent to the weld. The composition of the alloy has been altered in such a way as to invariably establish corrosion couples. Erosion of ceramics is typified by passivating oxides combining with hot salts to form compounds which melt and flow or dissolve away. Fresh ceramic material is exposed and the process repeats indefinitely.

Conversion of metal substrate surfaces to diffusional silicide, nitride, carbide and/or carbonitride compound layers has been disclosed in several patents. One or more features are common to all the approaches shown in these patents, and all the approaches differ from the present invention. Some require substrate enclosure in a treatment chamber which is held at a low pressure, in some ions are supplied by glow discharge plasma or ion beam; and some regions treatment duration of several to tens of hours. Specifically, in U.S. Pat. Nos. 5,308,707; 5,240,514; 5,176,760 and 5,062,900, the substrate is incorporated into a circuit and ions are produced by glow discharge, the former requires substrate electrical isolation for safety thereby limiting in-situ application as does glow discharge production of ions. Glow discharge ions occur at reduced pressure (on the order of $10^{-4}$ torr, compared with atmospheric pressures sustainable in the present invention) which severely limits or prevents in-situ application. With glow discharge approaches, either (1) the substrate must be enclosed in an air tight chamber thus requiring a large, typically off-site, facility to accommodate the substrate; or (2) smaller portions of the final assembly are treated and transported thereby incurring damage which negates the effect of treatment. In U.S. Pat. No. 4,704,168 the reactive ions are produced and formed into a beam by a gas ion source which requires the substrate to be enclosed in a reduced pressure treatment chamber. In these patents ions react thermochemically with a metal substrate to produce wear; damage; and corrosion-resistant diffusional layers associated with distinct color changes, as is common with the present invention. They are inadequate in method and application to provide in-situ and on-site treatment of the substrate after the final welding step or just prior to final unit assembly. The present invention specifically operates at this point in construction; therefore, transportation and subsequent damage of off-site treated objects is precluded. One patent, U.S. Pat. No. 4,981,756, generates a plasma region by magnetic coil deflection of an arc discharge between cathode and anode. However, the purpose of U.S. Pat. No. 4,981,756 is to lengthen electrode life as opposed to effecting uniform ionized plasma gas distribution. U.S. Pat. Nos. 5,240,514 and 5,296,272 require supplemental heating of substrate to reaction temperature instead of depending on plasma heating. In these the plasma provides only reactive species adding little energy to drive the thermochemical reaction in the substrate. This method of heating prevents rapid quenching of the treated surface thereby preventing super plastic enhanced wear surface properties from deriving from the treatment obtained in the present invention. In U.S. Pat. Nos. 5,302,422; 5,226,975; 5,138,520; 4,931,306 and 4,881,983, the plasma provides thermochemical reaction energy, but predeposited or codeposited materials are ionized. In the present invention all reactants may be supplied in reactive gases. In U.S. Pat. No. 4,818,351 the diffusional conversion layer is formed without ion involvement.

Two U.S. Pat. Nos. 4,999,215 and 4,505,947 relate to depositing films of materials on outer surfaces of substrates. In U.S. Pat. No. 4,505,947, the compounds are formed above the substrate at atmospheric pressures, with an arc discharge magnetically rotated between coaxial electrodes. Reactive ions are sourced by gases or preferably solids which are ionized in-situ, the compounds form and precipitate onto the substrate. Ions are involved in compound formation; however, diffusional thermochemical conversion layers are not formed in the substrate, therefore debonding occurs between the surface and the deposited layer.

U.S. Pat. No. 4,587,430, relates only to plasma generation describing a vacuum vessel with spark gaps which ionize one electrode material with subsequent control the trajectory of the reactive ions by magnetic fields. The present invention obtains all ions from the reactive gases which participate and support the plasma generating arc.

As described in the literature of this field, reactive plasma diffusional surface modification is currently being performed in treatment vessels at reduced pressures, required for glow discharge plasma. Matsuda, Nakata, Makishi and Kiya, nitrided Ni and nitride forming elements such as Ti, Zr, Cr, Mo, Fe, and other elements by a Plasma Ion Nitriding (PIN) apparatus and show that binary alloys have improved corrosion resistance (F. Matsuda, K. Nakata and T. Makishi, and S. Kiya, "Surface Hardening of Ni Alloys by Means of Plasma Ion Nitriding (PIN) Process (Report II)," Transactions of JWRI, v17 no.2 (1988)). Surface hardening was observed in all Ni alloys with a maximum hardness in the range of approximately Hv550–800 for Cr containing alloys with more than 20 wt % Cr (F. Matsuda, K. Nakata, T. Makishi, and S. Kiya, "Corrosion Behavior of Tentative Nickel Binary and Ternary Alloys after Plasma Ion Nitriding Treatment," Transactions of JWRI, v17 no.2 (1988)). Li, O'Keefe and James, "Ion Carbide Films Formed by Plasma Deposition in Plasma Carburizing," Materials Science & Engineering, B. Solid-Stat, v. 7n. 1/2, 15. (Sep. 1, 1990), formed iron carbide films by plasma deposition and plasma carburizing using vacuum vessel. Kanayama, Horie and Nakayama, "Plasma-Carburizing of Tungsten with a $C_3H_8$-$H_2$ Mixed Gas," Isij International, v. 33 n.5, 615, (1993), plasma carburized metal substrates in a vacuum vessel. Ricard, Oseguera-Pena, Falk, Michel and Gantois, ("Active Species in Microwave Postdischarge For Steel-Surface Nitriding," I.E.E.E. Transactions on Plasma Science, v. 18, No. 6 (December, 1990)), used a microwave vacuum vessel to ion treat metal surfaces.

There is thus a need for a method and apparatus by which reactive plasma surface modification may be conveniently applied to metal and ceramic substrates in order to respectively prevent corrosion and erosion, simultaneously improve wear resistance, and passivate against oxidation. The compounds formed would optimally be refractory hard intermetallics with high melting points, high resistance to abrasion and not reactive with molten salts. They would be mutually miscible, therefore no grains would be formed to provide micro scale corrosion couples. Corrosion and erosion would be prevented, and the process could be performed in-situ, without the need for cumbersome equipment or facilities.

DISCLOSURE OF THE INVENTION

In accordance with the present invention, a method and apparatus for treating a metal or ceramic surface of an object are disclosed. The method includes providing at least two electrodes; passing reactive gases past the electrodes; passing an electric current between the electrodes to create an electric arc to form a plasma of heated, ionized reactive gases; and bringing the plasma into contact with the surface to be treated, to cause a chemical reaction between the ionized gases and the surface, forming a new substrate surface in the object.

The process of the invention may be performed at atmospheric pressure, thereby allowing treatment to be performed on-site, without the need for moving the surface to a treatment facility, and without the need for bringing additional equipment to the site to reduce air pressure. To aid in performing on-site operations at atmospheric pressure, an inert gas may be provided to shield the plasma and the surface from the surrounding air. The operation optimally takes place between 600°and 1,100° C., but may occur at any temperature below the melting point of the metal or ceramic surface to be treated, typically around 1,400° C. or more.

In view of the foregoing, several advantages of the present invention are apparent. A method and apparatus for reactive plasma surfacing are provided which may be utilized on site without the need for cumbersome and expensive equipment or facilities for providing reduced air pressure. The treated surface is not merely coated, but is actually transformed into a new diffusional surface substrate by chemical reaction with the reactive gases. Additionally, large areas of the surface may be treated relatively rapidly by brushing the plasma over the selected areas.

Additional advantages of this invention will become apparent from the description which follows taken in conjunction with the accompanying drawings.

BEST MODE FOR CARRYING OUT THE INVENTION

Figure 1:
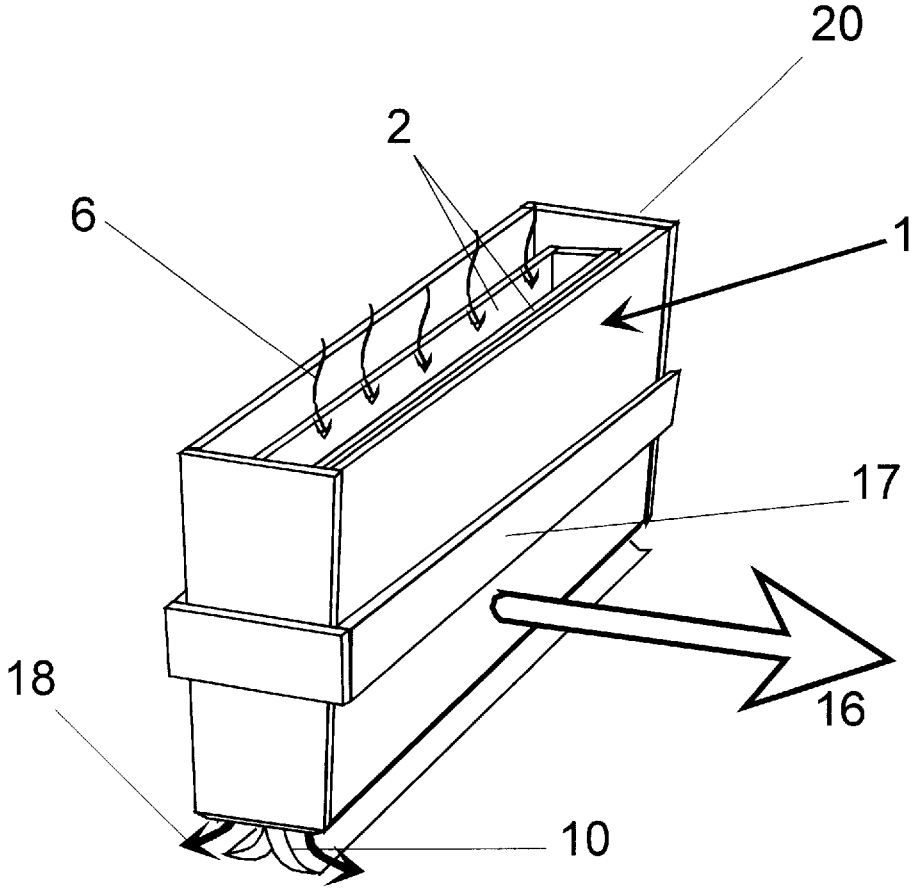
FIG. 1 is a perspective view of the reactive plasma surfacing torch of the present invention.
Figure 2:
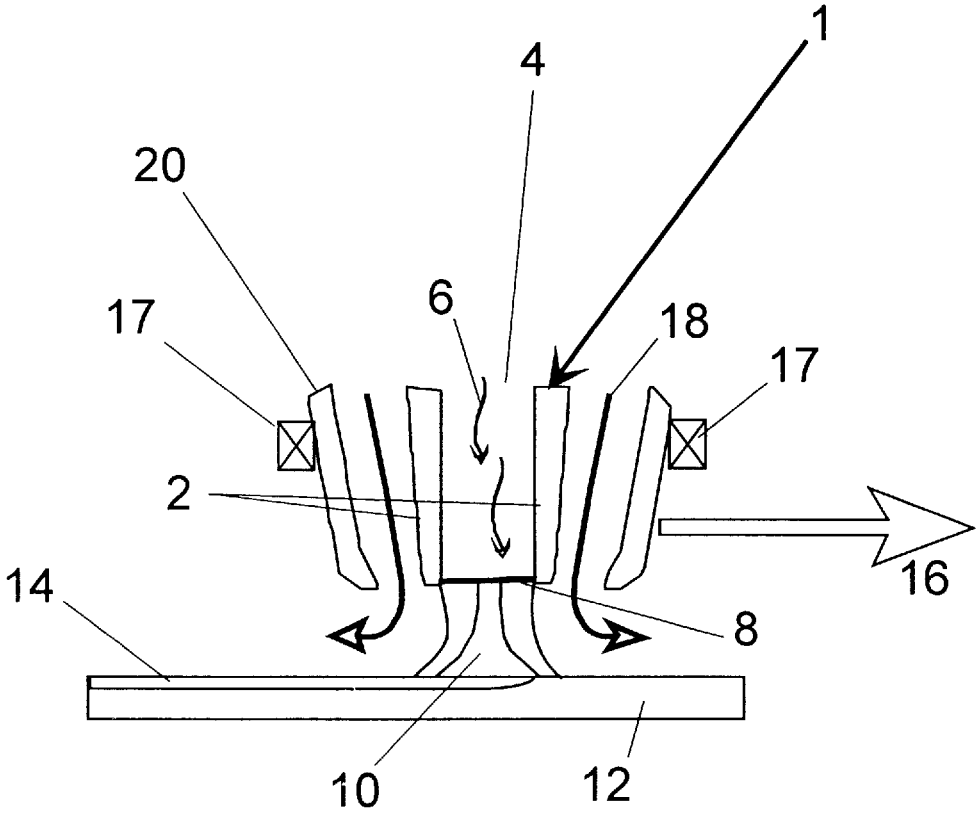
FIG. 2 is a side schematic view of the torch showing the newly formed diffusional substrate created by the method of the invention.
Figure 3:
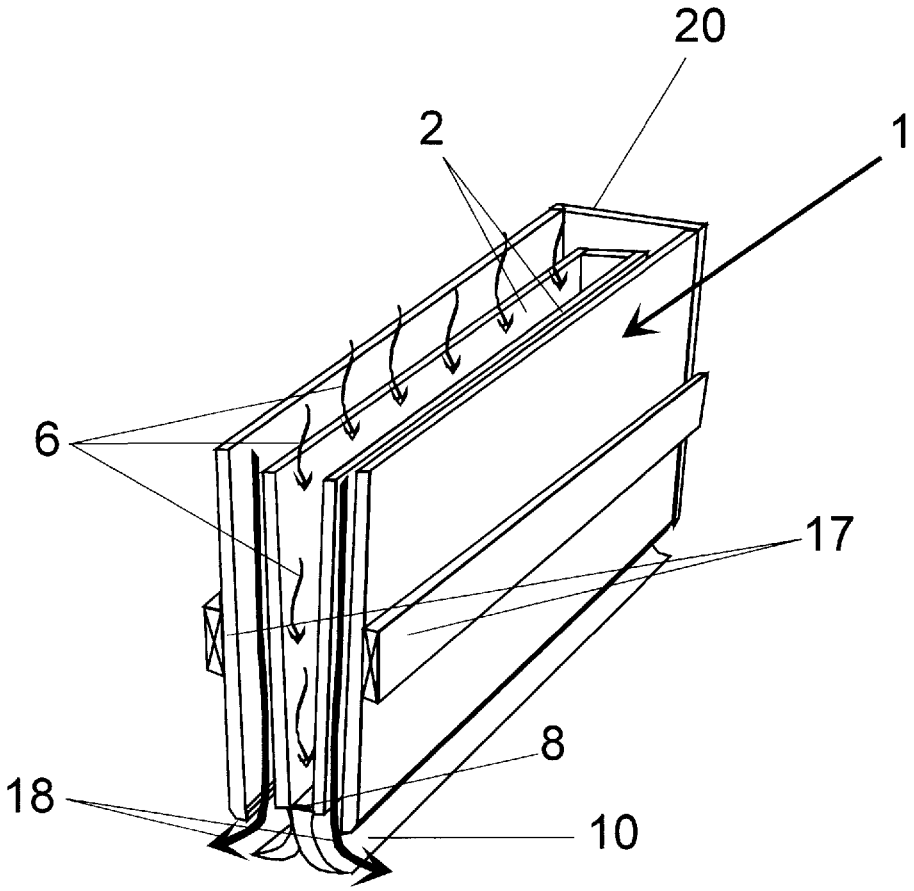
FIG. 3 is a cutaway view of the torch of FIG. 1, showing internal aspects of the torch.

Referring now to the drawings, as shown in FIGS. 1–3, there is depicted a reactive plasma surfacing torch 1. The torch 1 has a pair of electrodes 2 which form a channel 4 therebetween through which reactive gases 6 may be passed. Reactive gases which are particularly effective for use in this invention include silanes, such as $SiH_4$; alkanes such as $CH_4$, $C_2H_6$, and $C_3H_8$; boranes such as $B_2H_6$, $B_4H_{10}$, and $B_5H_9$; nitrogen sources such as $NH_3$, $N_2H_4$, ammonium compounds, and $N_2$; and transition metal organic compounds. A schematic representation of the process is shown in FIG. 2. Ideally, the gases 6 are diluted with inert gases to obtain optimal levels of reactivity.

When a current is passed through the electrodes 2, an electric arc 8 is created between the electrodes. The arc 8 heats and ionizes the reactive gases 6, forming a plasma 10. This result may be accomplished with a relatively low current, typically less than 100 amps. The heated ionized plasma 10 is forced from the torch 1 by gas pressure and by the heat of the arc 8. At the surface 12 the plasma 10 bathes and chemically reacts with the surface elements to form a new diffusional substrate surface 14. The torch 1 is moved along the surfacing direction 16, coating a swath of the surface 12 as it moves across the surface. A varying electric current through optional magnetic coils 17 creates a varying magnetic field which interacts with the current in the electric arc 8 to move the electric arc 8 perdendicularly to the surfacing direction 16 to provide a uniform sheet of plasma and a wide swath for coverage of the substrate. Standard electromagnetic interactions between the magnetic field and the current in the electric arc provide the force to move the arc along the electrodes at frequencies preferably between 0.1–5 kHz. Preferably, the channel 4 is relatively untapered and open-ended, thus providing a wider swath as the torch 1 is moved across the surface 12.

The properties of the new diffusional coating 14 are determined by the composition of the surface 12 being treated, the reactive gases 6 used in the process, and the temperatures and duration of exposure of the surface 12 to the plasma 10. The depth of the diffusional coating 14 is controlled by the sweep rate of the torch 1 across the surface 12 and the temperature of the surface 12. This temperature is in turn controlled by the intensity of the arc 8 and the distance from the electrodes 6 to the surface 12 (the "stand-off" distance). The surface temperature required to form the coating 14 is optimally 600° to 1,100° C., which is well below the melting point of metal alloys and ceramics. In this temperature range, the plasma ions diffuse below the actual surface 12 of the treated object to a depth of 10–200 micrometers, and react with the metal or ceramic materials therein to form a new surface down to such depth. This is substantially different from traditional coating technologies, and has significant advantages over such apparatus particularly for high-stress applications. Examples of applications which could benefit greatly from utilization of this approach to form a new diffusional substrate surface include metals and ceramics exposed to aqueous and molten salts, acids, and bases in temperature ranges up to 1,800° C.

A particular example of the intermetallic formation of nickel, common in many construction metal alloys such as IN-738 and A-625, is given here for the reactive gases $SiH_4$, $CH_4$, $B_2H_6$, $NH_3$:

$$5SiH_4+2Ni(A\text{-}625)+5O_2 \rightarrow Ni_2Si_5+1OH_2O \text{ (silicide)} \quad (1)$$

$$CH_4+3Ni(A\text{-}625)+O_2 \rightarrow Ni_3C+2H_2O \text{ (carbide)} \quad (2)$$

$$2B_2H_6+4Ni(A\text{-}625)+3O_2 \rightarrow 4NiB+6H_2O \text{ (boride)} \quad (3)$$

$$4N_3+4Ni(A\text{-}625)+3O_2 \rightarrow 4NiN \text{ (nitride)} \quad (4)$$

where oxygen, required for completing the surfacing chemistry, is supplied by aspiration of atmospheric gases through the inert shielding gas to the reactive gas plasma. Analogous surface chemistry can be anticipated with other alloy constituents and reactive gases.

For best results, an inert gas 18 is used to shield the torch 1 and the surface 12 from the surrounding atmosphere. This may be accomplished by use of a surrounding cup 20 through which the inert gas 18 is passed. Substrate corrosion and damage resistance are controlled by composition, thickness and diffusional gradient of the intermetallics formed out of the surface. The composition is determined by the choice of reactive gas and the composition of the surface being treated. Of particular importance to the damage resistance is the thickness and gradient of the coating. Refractory metal and transition metal intermetallics are hard and typically have thermal expansion coefficients which are within a factor of 2 of typical base metal alloys. This, together with the resiliency of the underlying metal, the low temperature of formation which prevents alteration of the bulk metal mechanical properties, a diffusional gradient and a thin (0.02–8 mils) coating thickness control possible adverse impact to the ductility of the coated metal. The intermetallics are typically slow to oxidize so they are stable in highly oxidizing atmospheres.

This invention has been described in detail with reference to a particular embodiment thereof, but it will be understood that various other modifications can be effected within the spirit and scope of this invention.

I claim:

1. A method of treating a metal or ceramic surface of an object, comprising:

providing at least two electrodes neither of which comprise said surface;

passing reactive gases at atmospheric pressure past said electrodes;

passing an electric current between said electrodes to create an electric arc to form a plasma of heated, ionized reactive gases;

bringing said plasma into contact with the surface at a temperature below the melting point of the surface to cause a chemical reaction between the ionized gases and a material of the surface to form a new compound diffused into the surface of the object.

2. A method of treating a metal or ceramic surface of an object as claimed in claim 1, wherein:

the reactive gases are taken from the group consisting of silanes, alkanes, boranes, nitrogen sources, and transition metal organic compounds.

3. A method of treating a metal or ceramic surface of an object as claimed in claim 1, further including;

providing an inert gas between the reactive gases and surrounding atmosphere to shield the reactive gases from interaction with the atmosphere.

4. The method of treating a metal or ceramic surface of an object as claimed in claim 1, further including the step of;

providing electromagnetic coils for selectively moving the arc between said electrodes by altering a current through said coils, thereby selectively moving the plasma.

* * * * *